United States Patent [19]

Crepinsek

[11] 4,027,907

[45] June 7, 1977

[54] SECURITY CHAIN LOCK FOR DOORS

[75] Inventor: Alois Crepinsek, El Paso, Tex.

[73] Assignee: International Top Security Corporation, El Paso, Tex.

[22] Filed: Apr. 8, 1976

[21] Appl. No.: 675,215

[52] U.S. Cl. ..... 292/264; 70/93; 292/59

[51] Int. Cl.[2] ..... E05C 17/06; E05C 17/36

[58] Field of Search ..... 70/93; 292/264, 262, 292/DIG. 41, DIG. 44, DIG. 60, 59

[56] References Cited

UNITED STATES PATENTS

| | | | |
|---|---|---|---|
| 198,553 | 12/1877 | Aver | 292/264 |
| 2,454,794 | 11/1948 | Hakanson | 292/264 |
| 2,946,213 | 7/1960 | Reiner | 292/264 X |
| 3,667,794 | 6/1972 | Lentz | 292/264 |
| 3,897,966 | 8/1975 | Draughon | 292/264 |

*Primary Examiner*—J. Franklin Foss
*Attorney, Agent, or Firm*—D. Paul Weaver

[57] ABSTRACT

A security chain lock for doors features a chain housing and guideway attached to the interior side of the door and coupled securely to door lock cylinder housing means. An extension of the chain housing laps the edge of the door through which the door lock bolt projects and is firmly anchored to such edge. A keeper mounting bracket is rigidly secured to the inner face and to the edge of the door frame which faces the door edge. A keeper housing is pivotally secured to said mounting bracket and receives a spring-urged keeper projecting from a reciprocatory release element joined to the keeper housing and adapted to enter an inaccessible chamber of the door frame when the keeper housing is pivoted in response to partial door opening from the inside while the chain lock is active. A coacting latch element connected with the extensible and retractable chain means is shiftable by an interior knob into active coupling engagement with the keeper in the keeper housing. The latch element and chain means are resiliently biased to retracted positions within the chain housing.

12 Claims, 5 Drawing Figures

SECURITY CHAIN LOCK FOR DOORS

CROSS-REFERENCE TO RELATED APPLICATION

This application contains some subject matter in common with copending application Ser. No. 599,093, filed July 25, 1975, for SAFETY CHAIN LOCK FOR DOORS, Alois Crepinsek, inventor.

BACKGROUND OF THE INVENTION

A strong need exists for a more secure and safe interior chain lock for the doors of apartments and homes to prevent forcible entry by intruders. Available chain locks commonly employ a keeper attached to the interior of the door frame by two small screws and a chain anchor similarly attached to the interior side of the door. With such a lock, after the door has been partially opened from the inside, an intruder can easily burst into the dwelling by giving the door a sound kick or an abrupt push with the shoulder. Such action will dislodge the small screws which anchor the device to the door and door frame.

Therefore, the object of this invention is to improve on the known prior art and to satisfy the existing need of the art by the provision of a truly secure and safe interior chain lock for doors sometimes referred to as a "night lock". In accomplishing this objective, the invention provides a sturdy housing for a spring-urged extensible and retractable chain means and an associated latch element. The housing is securely anchored to the door lock cylinder housing means, which housing means cannot be separated from the outside of the door by an intruder. Such a housing means is disclosed in U.S. Pat. No. 3,934,437, issued Jan. 27, 1976 to Crepinsek and also in the above-referenced copending application. In some cases, the chain housing and guideway means may be connected with another type of door lock or may be securely attached to the door interior away from the door lock and bolt means. The chain and chain latch housing is further securely anchored to the free edge of the door through which the door lock bolt normally projects and thus the housing is secured to the door at two right angular planes as well as to the door lock cylinder housing making it virtually impossible to dislodge the housing.

Similarly, a sturdy mounting bracket for a keeper housing which receives the extensible chain latch element is secured firmly to both the inner face and to the edge of the door frame which faces the free edge of the door. The keeper housing has a pivotal connection with the frame attached mounting bracket and the keeper within the housing is spring-urged toward an active position relative to the coacting chain latch element and is mounted on a reciprocatory panic release member or knob which is normally accessible at the inner side of the door but only when the door is closed. Thus, in a panic situation on the inside of the door, the occupant of the dwelling space can quickly release the chain lock. However, with the chain lock active and with the door partially open, the panic release member swings with the pivoted keeper housing into an inaccessible chamber of the door frame behind the frame attached mounting bracket, and in this position neither the intruder nor the occupant can release the chain lock. Upon completely closing the door, the occupant can again release the chain lock by operating the reciprocatory release member or knob, and the spring-urged chain and latch element will retract automatically into the housing and guideway. The device is very strong, compact, neat in appearance, and relatively economical to manufacture. Its use gives great security in situations where presently-available chain locks and the like are practically useless in resisting forcible entry after the door is cracked open by the occupant.

Other features and advantages of the invention will become apparent during the course of the following description.

BRIEF DESCRIPTION OF THE DRAWING FIGURES

DETAILED DESCRIPTION

Figure 1:
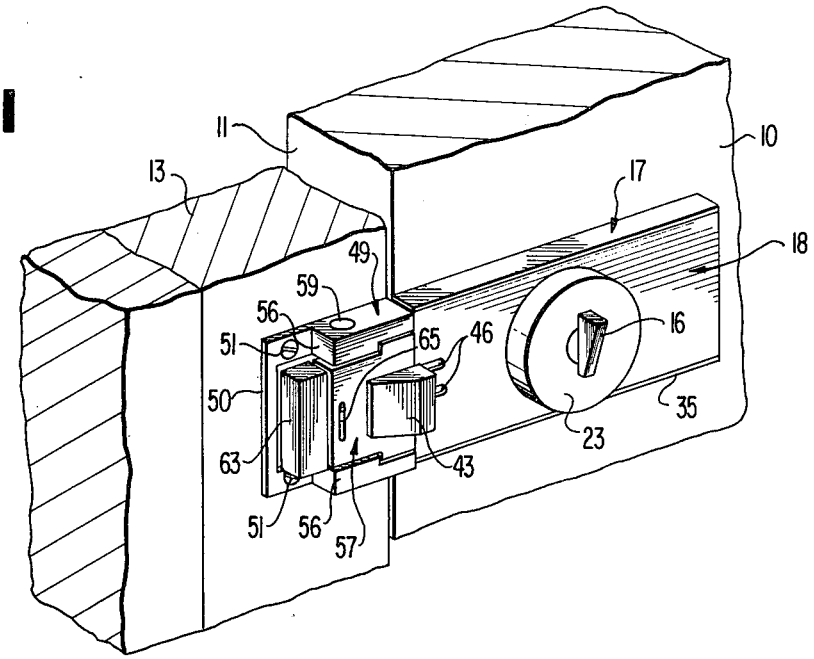
FIG. 1 is a perspective view of a chain lock for doors embodying the invention with the door fully closed.
Figure 4:
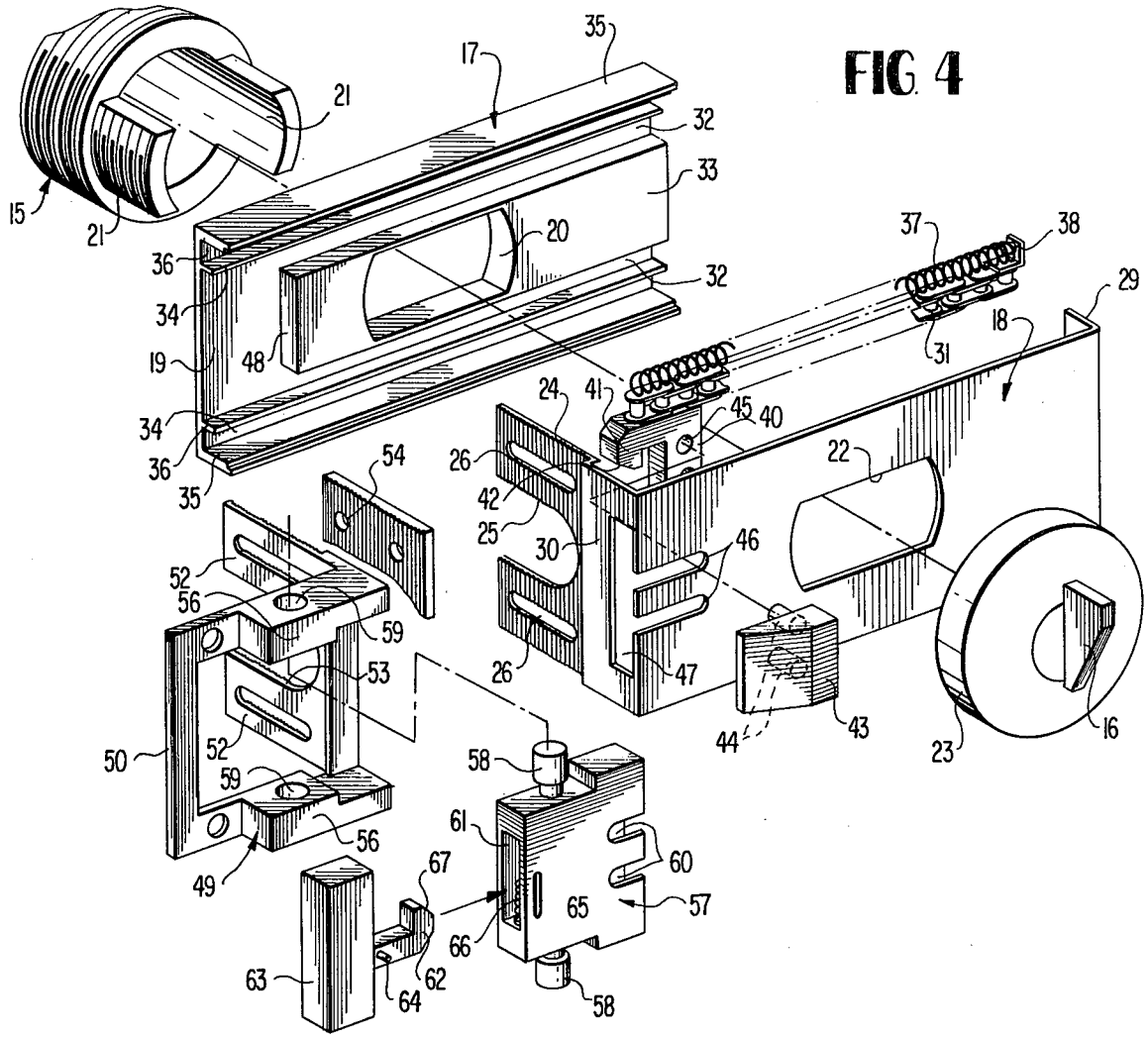
FIG. 4 is an exploded perspective view of the chain lock.
Figure 5:
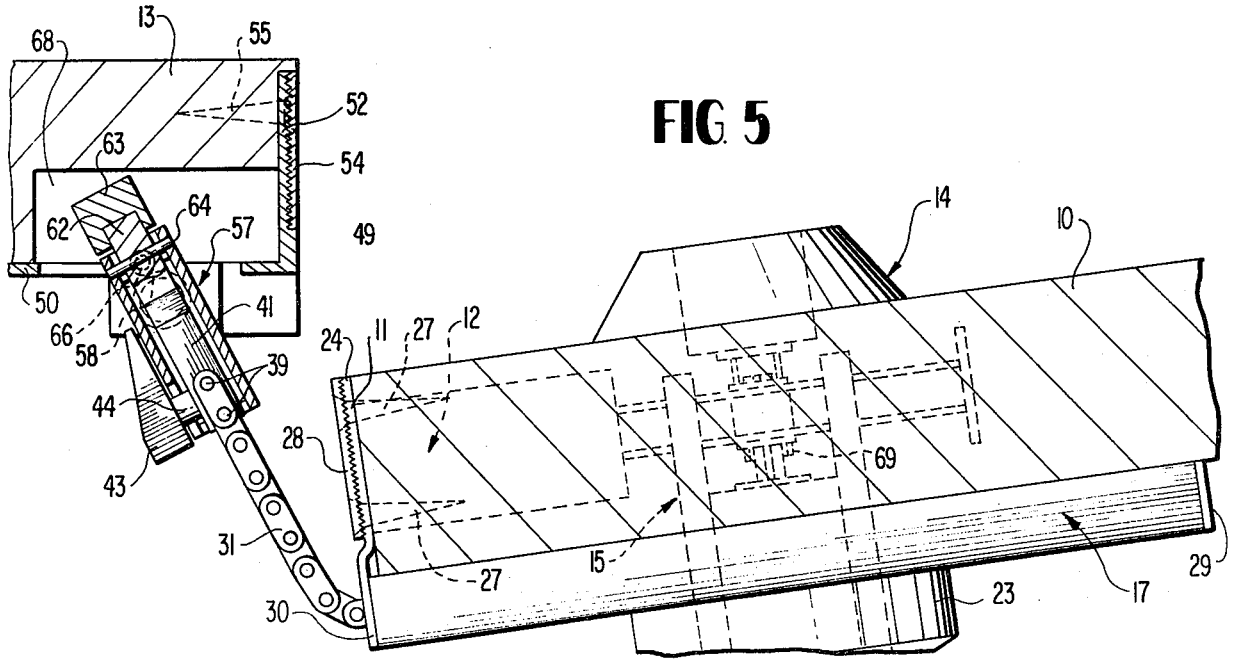
FIG. 5 is a horizontal cross-sectional view taken through a door and door frame on which the invention is installed and showing the pivoted keeper housing and panic release member in an inaccessible chamber of the door frame when the door is cracked open.

Referring to the drawings in detail wherein like numerals designate like parts, the numeral 10 designates a horizontally swinging door of a swelling place having a free edge 11 through which door lock bolt means 12, FIG. 5, projects to enter the usual bolt receiving socket or recess in the opposing face of a door frame 13. As illustrated in FIG. 5 somewhat schematically by broken lines, the swinging door 10 is preferably equipped with a door lock cylinder housing means 14 of the type shown in the above-referenced copending application and also in the referenced U.S. Pat. No. 3,934,437. This lock cylinder housing means includes a threaded coupling component or sleeve 15 shown in FIG. 4 as well as in FIG. 5. The details of the door lock cylinder housing means are known and need not be described for a full understanding of this invention. Suffice it to say, as disclosed in said prior patent, the lock cylinder housing means 14 on the door 10 cannot be disassembled or separated from the outside of the door by an intruder. Therefore, with the invention securely anchored to the lock cylinder housing means 14, in a manner to be described, no intruder on the outside can dislodge the chain lock from the door, as will become apparent. FIG. 5 additionally shows schematically the intersecting relationship of the door lock bolt 12 with the lock cylinder housing means 14 as disclosed in said prior patent and copending application, to prevent disassembling the lock cylinder housing means by anyone, except when the door is opened so that its free edge 11 is exposed to render accessible a certain release mechanism as disclosed in said patent. While this invention is disclosed in association with a particular door lock mechanism and lock cylinder housing means, it should be understood that the invention may be used in association with other lock mechanisms, or may in some cases be secured directly to the inner side of a door separately from and remote from the door lock, knob or housing. The present illustrations in FIGS. 1 and 5 show a door lock whose bolt 12 can be retracted by use of a key from the outside of the door or by turning a knob element 16 from the inside of the door, as will be further described.

The chain lock mechanism forming the subject matter of this invention comprises a channel-like housing section and guideway 17 and a cooperating housing and guideway cover 18 for an extensible and retractable spring-urged chain and chain latch means, to be described. The housing section 17 has a flat base plate 19 which abuts the inner face of the door 10 and has a central oblong opening 20 which receives spaced threaded extensions 21 of threaded coupling member 15 which, as stated, is a part of the known door lock cylinder housing means 14. When the housing means 14 is fully assembled, no part of it including coupling member 15 can rotate due to the intersecting relationship of the bolt assembly 12 with the housing means, as disclosed in said patent. Therefore, the housing section 17 cannot rotate because of the relationship between the oblong opening 20 and the coupling extensions 21 extending therethrough.

The housing cover 18 has a like oblong opening 22 formed therethrough centrally to also receive the extensions 21 in assembly, FIG. 5. An internally threaded cap or rosette 23 is applied to the threaded extensions 21 inwardly of the cover 18 and clamps the cover in assembled relationship with the housing section or body 17. Additionally, FIGS. 4 and 5, a right angular extension 24 of the cover 18 laps the free edge 11 of the swinging door 10 and has a large central slot 25 to receive the door bolt assembly 12 and additional slots 26 to receive at least two anchoring screws 27, which screws also serve to secure a plate element 28 of the door bolt housing at the free edge of the door 10, FIG. 5. Preferably, the opposing faces of the plate element 28 and plate extension 24 are serrated as indicated in the drawings. Thus it may be seen that the housing cover 18 is firmly secured both to the interior side of the door 10 and to the edge 11 thereof for greatly increased security. When fully assembled, FIGS. 1 and 5, end flanges 29 and 30 of the cover 18 extend across and close the ends of channel-like housing section 17.

Within the housing composed of the two elements 17 and 18 is a pair of chains 31 for double strength and these two sections of chain ride in guideways 32 formed by the sides of a thickened portion 33 of housing section 17 and adjacent parallel flanges 34 integral with the base plate 19. These flanges are spaced from the side walls 35 of housing section 17 to provide passages or channels 36 for chain retracting expansion springs 37 contained therein. Each spring 37 has one end bearing against the housing flange or wall 30 and its opposite end engaging an extension 38 secured to the adjacent end of the associated chain section 31, whereby the expansive force of the spring constantly biases the chain section into the chain housing and guideway means.

The forward ends of chain sections 31 are securely joined by cross pins 39 to a chain latch bar 40 having a hook-like latch head 41 extending forwardly thereof and provided with a beveled leading face 42. A slider knob 43 on the interior of housing cover 18 is coupled by a pair of pins 44 with the chain latch bar 40, the latter having a pair of openings 45 in one side thereof to receive the pins 44. The housing cover 18 is slotted at 46 to allow movement of the two pins 44 relative to the stationary housing and an end slot 47 in the housing cover allows manual extension of the chain latch 41 through the end of the housing and beyond the edge 11 of the door at proper times. When released, the latch 41, knob 43 and chains 31 will be retracted as a unit inside of the housing 17 by action of the springs 37. When fully retracted, the latch bar 40 will strike an end face 48 of housing portion 33 which end face forms a stop for the retractive movement of the chain latch, FIG. 2.

A generally L-shaped keeper mounting bracket 49 is attached securely to the door frame 13 along two right angular planes similar to the attachment of the housing cover 18 to the door 10. One frame portion 50 of the mounting bracket 49 is secured by screws 51, FIG. 1, to the interior face of the door frame, and slotted right angular extensions 52 of the bracket 49 are similarly secured to the edge of the door frame which opposes the door edge 11, there being a large slot 53 between the extensions 52 to receive the projecting door bolt when the door is closed and locked normally. The screws which anchor the slotted extensions 52 also pass through a striker plate 54 which has a door bolt receiving opening in registration with the slot 53, the attachment screws being indicated at 55 in FIG. 5. The opposing faces of the extension 52 and plate 54 are serrated, as shown in the drawings.

Figure 2:
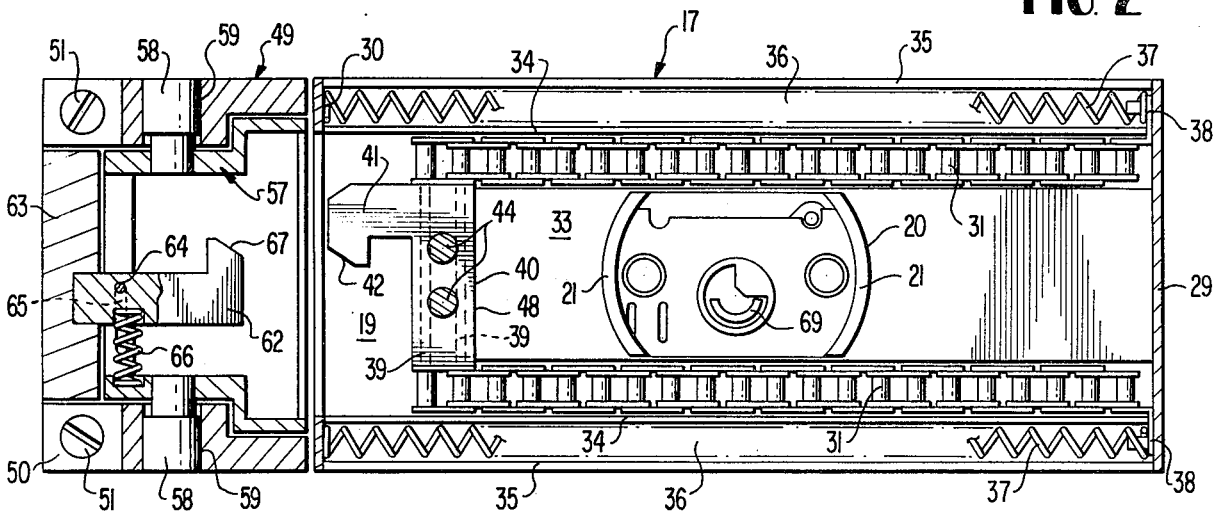
FIG. 2 is an enlarged vertical section, partly in elevation, through the chain lock in a released condition and showing the chain and chain latch housing and guideway means and the associated keeper housing and release means.
Figure 3:
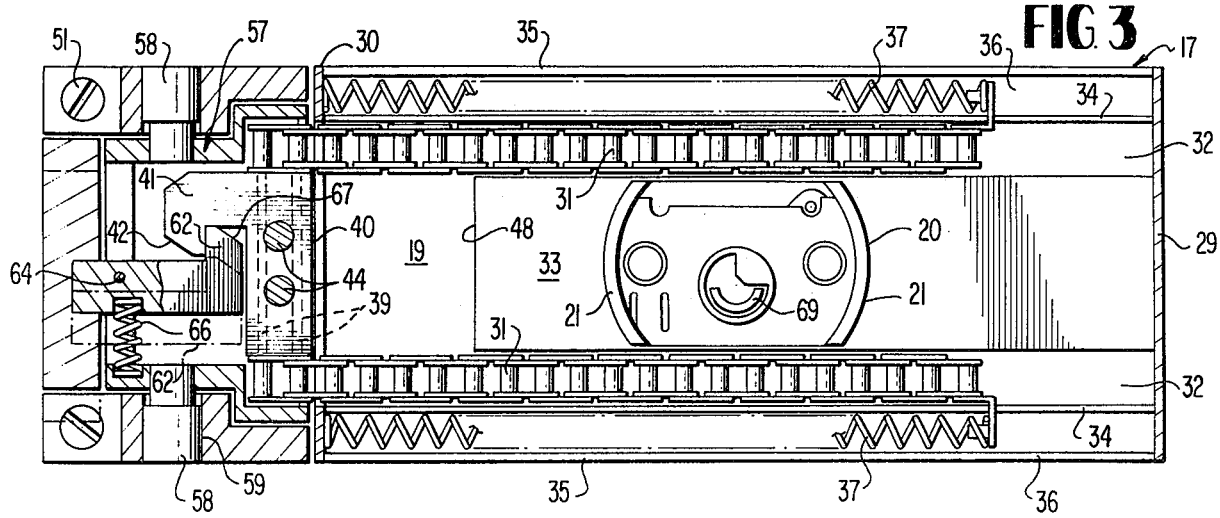
FIG. 3 is a similar view showing the chain lock in the active or locking position.

On the inner side of the door frame, mounting bracket 49 has integral vertically spaced apertured bearing blocks 56, between which is pivotally mounted a keeper housing 57 having top and bottom pivot shafts 58, received rotatably in the apertures 59 of bearing blocks 56, whereby the housing 57 may pivot in a horizontal plane relative to the bracket 49 at certain times. The end of the keeper housing 57 which opposes the slot 47 is open to receive the chain latch head 41 and bar 40 at proper times, along with the forward terminals of the two chains 31, see FIG. 3. The interior side wall of housing 57 is slotted at 60 to accommodate the two pins 44 of slider knob 43. The other end of housing 57 has a smaller rectangular opening 61 receiving a hook-like keeper 62 rigidly secured to a block-like panic release element or knob 63 which lies immediately inwardly of mounting bracket frame portion 50 and is adapted to be shifted vertically in a linear path relative to the bracket 49. The keeper 62 and release element 63 are connected as a unit to the keeper housing 57 by a pin 64 which projects from the keeper 62 and enters a vertical guide slot 65 of the housing 57. The keeper 62 is biased upwardly in the housing 57 toward the top of slot 65 by a compression spring 66 arranged as shown in FIGS. 2 and 3. The keeper 62 has a beveled face 67 to engage and ride over the face 42 of latch head 41 when the chain latch and chain are extended by use of the manual knob 43. When this occurs, the keeper 62 and latch head 41 move into interlocking engagement, FIG. 3, the keeper first descending to the broken line position shown in FIG. 3 and then returning upwardly under influence of the spring 66 to lock behind the latch head 41. During such linear reciprocation of the keeper 62, the latter is guided by the slot 65 and pin 64 as well as by the side wall of the housing 57. The keeper release element 63 is external to the housing 57 and close to its rear end, as shown. To release the chain lock from the inside of the door in a panic situation, it is merely necessary to push the element 63 downwardly against the spring 66 and this will instantly release or unlock the keeper 62 from the latch head 41, and the latch head and chains will then retract into the housing 17 so that the door can open.

There is a further important safety feature of the invention to defeat intrusion from the outside of the door 10 and this feature is shown in FIG. 5 of the drawings. When the chain lock is rendered active as in FIG. 3 and someone seeks entry from the outside of the door 10, the door may be cracked open as shown in FIG. 5 and the two chain sections 31 will extend to permit this slight opening of the door. The extent of chain extension, however, is positively limited by chain length as well as length of the chain housing and guideways and the door will not open more than a slight amount. This allows the occupant to know the identity of the outsider and to decide whether to admit him or her. The outsider cannot at any time force the door further open by physical force because of the extreme strength of the mechanism and its manner of attachment to the door and door frame.

Additionally and to further describe the last-mentioned safety feature, as the door is cracked open, FIG. 5, the keeper housing 57, together with the attached keeper release element 63, will pivot on the axes of the shafts 58 and bearing openings 59 and this will swing the panic release element 63 into a concealed and inaccessible chamber or recess 68 of the door frame 13 behind the mounting bracket 49. At this time, neither the potential intruder outside of the door 10 nor the occupant of a dwelling space may release the chain lock because the panic release element 63 cannot be reached, and this constitutes an excellent safety feature. As soon as the door is reclosed, the element 63 returns to its normal position shown in FIG. 1 outside of the chamber 68 and can be depressed by anyone at the inside of the door to release the chain lock in the previously-described manner.

As was previously mentioned, the door lock bolt 12 forming no direct part of this invention may be retracted by means of a key from the outside of the door or by means of the interior knob 16 which can rotate relative to the rosette 23 and has the usual rotary spline means 69 to actuate the bolt as disclosed in said prior patent. No further description of this mechanism is necessary and, as stated, the successful use of the invention is not dependent upon the employment of any particular door lock or bolt mechanism, even though the mechanism in said prior patent is ideally suited to the invention.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A chain lock for doors comprising a housing secured to the interior side of a door near the free-swinging edge thereof, an extensible and retractable chain and chain latch means within the housing and adapted to be extended beyond one end of the housing, a latch keeper assembly mountable upon a door frame adjacent to said one end of the housing and adapted to lockingly engage with said chain and chain latch means when the latter is extended beyond said one end of the housing, said latch keeper assembly including a manual release element accessible from the interior side of a door when such door is closed, and means anchoring said housing to a lock cylinder housing means of a door, said last-named means including an oblong opening formed through said housing laterally, and a threaded clamping rosette engaging the interior side of the housing and adapted for threaded engagement with a threaded coupling member of a door lock cylinder housing means.

2. A chain lock for doors comprising a housing secured to the interior side of a door near the free-swinging edge thereof, an extensible and retractable chain and chain latch means within the housing and adapted to be extended beyond one end of the housing, and a latch keeper assembly mountable upon a door frame adjacent said one end of the housing and adapted to lockingly engage with said chain and chain latch means when the latter is extended beyond said one end of the housing, said latch keeper assembly including a manual release element accessible from the interior side of the door when the door is closed, and said latch keeper assembly including a pivoted keeper housing on which said manual release element is mounted for entry into an inaccessible door frame chamber when the door is cracked open while said chain and chain latch means and latch keeper assembly are actively engaged.

3. A chain lock for doors as defined in claim 2, and a substantially right angular mounting bracket attachable to two right angular faces of a door frame and carrying said pivoted keeper housing and manual release element, said inaccessible chamber being adjacent to a part of said right angular mounting bracket which is located on the interior side of a door frame.

4. A chain lock for doors comprising a housing secured to the interior side of the door near the free-swinging edge thereof, an extensible and retractable chain and chain latch means within the housing and adapted to be extended beyond one end of the housing, and a latch keeper assembly mountable upon a door frame adjacent said one end of the housing and adapted to lockingly engage with said chain and chain latch means when the latter is extended beyond said one end of the housing, said latch keeper assembly including a manual release element accessible from the interior side of the door when the door is closed, and said housing comprising a channel-like section on the interior face of a door having spaced parallel chain guideways therein, and a housing cover section overlying the channel-like section and said guideways and having an end substantially right angular extension adapted for securement to the free-swinging edge of a door, whereby the housing is anchored to a door in two right angular planes.

5. A chain lock for doors as defined in claim 4, and said latch keeper assembly including a substantially right angular mounting bracket attachable to the interior side of a door frame and to the edge of the frame opposing the free swinging door edge.

6. A chain lock for doors as defined in claim 5, and said right angular extension of the housing cover section and the corresponding opposing part of the right angular mounting bracket slotted to allow the passage of a door lock bolt.

7. A chain lock for doors as defined in claim 4, and said chain and chain latch means comprising a spaced parallel pair of chain sections engaging slidably in said chain guideways, a chain latch element interconnecting the leading ends of the chain sections, and spring means in said housing opposing extension of the chain sections and latch element from the housing and biasing such parts to retracted positions within the housing.

8. A chain lock for doors as defined in claim 7, and a manual slider knob on the interior side of the housing coupled with said latch element and operable to shift the latch element and said chain sections beyond one end of the housing and toward locking engagement with said latch keeper assembly.

9. A chain lock for doors comprising a housing secured to the interior side of a door near the free-swinging edge thereof, an extensible and retractable chain and chain latch means within the housing and adapted to be extended beyond one end of the housing, a latch keeper assembly mountable upon a door frame adjacent said one end of the housing and adapted to lockingly engage with said chain and chain latch means when the latter is extended beyond said one end of the housing, said latch keeper assembly including a manual release element accessible from the interior side of the door when the door is closed, and spring means biasing said chain and chain latch means to its retracted position within said housing.

10. A chain lock for doors comprising a housing secured to the interior side of a door near the free-swinging edge thereof, an extensible and retractable chain and chain latch means within the housing and adapted to be extended beyond one end of the housing, a latch keeper assembly mountable upon a door frame adjacent said one end of the housing and adapted to lockingly engage with said chain and chain latch means when the latter is extended beyond said one end of the housing, said latch keeper assembly including a manual release element accessible from the interior side of the door when the door is closed, and said chain and chain latch means comprising at least one chain section and a leading end latch element secured thereto, said latch keeper assembly including a cooperating spring-urged movable keeper which interlocks automatically with said latch element when the latter is drawn from said housing and into said keeper assembly, said latch element and keeper having engaging beveled faces, and said manual release element connected to said keeper.

11. A chain lock for doors as defined in claim 10, and said latch keeper assembly further including a housing for said spring-urged movable keeper having an open end facing said one end of the housing through which the latch element moves when extended from the housing, said manual release element arranged exteriorly of said keeper housing.

12. A chain lock for doors as defined in claim 11, and a door frame attached mounting bracket for said keeper housing and pivotally supporting the keeper housing and said manual release element, whereby the latter may enter an inaccessible door frame chamber when the keeper housing turns in one direction responsive to door opening while said chain lock is actively engaged.

* * * * *